US010210805B2

(12) United States Patent
Nagayama et al.

(10) Patent No.: US 10,210,805 B2
(45) Date of Patent: Feb. 19, 2019

(54) ORGANIC LIGHT-EMITTING DIODE (OLED) PIXEL CIRCUIT, DISPLAY DEVICE AND CONTROL METHOD

(71) Applicant: BOE TECHNOLOGY GROUP CO., LTD., Beijing (CN)

(72) Inventors: Kazuyoshi Nagayama, Beijing (CN); Song Song, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 341 days.

(21) Appl. No.: 15/031,498

(22) PCT Filed: Oct. 19, 2015

(86) PCT No.: PCT/CN2015/092198
§ 371 (c)(1),
(2) Date: Apr. 22, 2016

(87) PCT Pub. No.: WO2016/179962
PCT Pub. Date: Nov. 17, 2016

(65) Prior Publication Data

US 2018/0197462 A1 Jul. 12, 2018

(30) Foreign Application Priority Data

May 8, 2015 (CN) ..... 2015 1 0232424

(51) Int. Cl.
*G09G 3/325* (2016.01)
*G09G 3/32* (2016.01)
*G09G 3/3233* (2016.01)

(52) U.S. Cl.
CPC ..... *G09G 3/325* (2013.01); *G09G 3/32* (2013.01); *G09G 3/3233* (2013.01);
(Continued)

(58) Field of Classification Search
CPC ..... G09G 2320/043; G09G 2300/0861; G09G 2300/0842; G09G 3/3233
See application file for complete search history.

(56) References Cited

U.S. PATENT DOCUMENTS

2005/0269960 A1 12/2005 Ono et al.
2006/0044235 A1 3/2006 Lee et al.
(Continued)

FOREIGN PATENT DOCUMENTS

CN 1664901 A 9/2005
CN 100435189 C 11/2008
(Continued)

OTHER PUBLICATIONS

2nd Chinese Office Action, English Translation.
(Continued)

*Primary Examiner* — Abbas I Abdulselam
(74) *Attorney, Agent, or Firm* — Brooks Kushman P.C.

(57) ABSTRACT

The present disclosure provides an OLED pixel circuit, a display device and a control method. The OLED pixel circuit includes: an OLED; a driving transistor; a first switching unit; a second switching unit; a compensation circuit connected to the gate electrode of the driving transistor and configured to maintain a voltage of the gate electrode of the driving transistor during a light-emitting period, so as to enable a current flowing through the OLED to be irrelevant to a threshold voltage Vth of the driving transistor; and a reference signal generation module configured to generate, based on a current threshold voltage of the driving transistor, a reference signal to be used by the compensation circuit, wherein a voltage of the reference signal and the threshold voltage meet at least one of validation conditions capable of validating the compensation circuit.

19 Claims, 4 Drawing Sheets

(52) U.S. Cl.
CPC ..... *G09G 2300/0819* (2013.01); *G09G 2300/0876* (2013.01); *G09G 2320/0233* (2013.01); *G09G 2320/045* (2013.01)

(56) References Cited

U.S. PATENT DOCUMENTS

| | | | | |
|---|---|---|---|---|
| 2007/0040772 | A1 | 2/2007 | Kim | |
| 2009/0284515 | A1 | 11/2009 | Tsuge | |
| 2011/0050659 | A1* | 3/2011 | Tsai | G09G 3/3233 345/205 |
| 2011/0273419 | A1* | 11/2011 | Park | G09G 3/30 345/211 |
| 2015/0001504 | A1 | 1/2015 | Kim et al. | |
| 2015/0294624 | A1* | 10/2015 | Liu | G09G 3/3233 345/690 |
| 2016/0180770 | A1 | 6/2016 | Duan et al. | |

FOREIGN PATENT DOCUMENTS

| | | | |
|---|---|---|---|
| CN | 101430859 | A | 5/2009 |
| CN | 100533530 | C | 8/2009 |
| CN | 102945654 | A | 2/2013 |
| CN | 103440840 | A | 12/2013 |
| CN | 103578405 | A | 2/2014 |
| CN | 103915061 | A | 7/2014 |
| CN | 103943067 | A | 7/2014 |
| CN | 104064139 | A | 9/2014 |
| CN | 104299572 | A | 1/2015 |
| CN | 104778925 | A | 7/2015 |
| JP | 2003-216109 | A | 7/2003 |
| JP | 2010-224390 | A | 10/2010 |
| JP | 2011-069943 | A | 4/2011 |
| KR | 10-2013-0002115 | A | 1/2013 |
| WO | 2014/174905 | A1 | 10/2014 |

OTHER PUBLICATIONS

Office Action in Chinese Patent Application No. 201510232424.5, dated Nov. 4, 2016.
International Search Report and Written Opinion in PCT International Application No. PCT/CN2015/092198, dated Feb. 5, 2016.
Second Office Action for Chinese Application No. 201510232424.5, dated Jun. 16, 2017, 13 Pages.
European Search Report for Application No. 15851606.2, dated Nov. 7, 2018, 10 pages.

* cited by examiner

ORGANIC LIGHT-EMITTING DIODE (OLED) PIXEL CIRCUIT, DISPLAY DEVICE AND CONTROL METHOD

CROSS REFERENCE OF RELATED APPLICATION

This application is the U.S. national phase of PCT Application No. PCT/CN2015/092198 filed on Oct. 19, 2015, which claims a priority of the Chinese Patent Application No. 201510232424.5 filed on May 8, 2015, the disclosures of which are incorporated in their entirety by reference herein.

TECHNICAL FIELD

The present disclosure relates to the field of display technology, in particular to an organic light-emitting diode (OLED) pixel circuit, a display device and a control method.

BACKGROUND

OLEDs have become important light-emitting elements in a new flat panel display device because they have advantages of self-luminescence, high contrast, wide color gamut, simple manufacturing process, low power consumption, enabling flexible display and etc.

In a pixel of an OLED display panel, each of sub-pixels includes a driving transistor. In an OLED pixel circuit, current flowing through the OLED is controlled by a data signal Vdata and affected by a threshold voltage Vth of the driving transistor.

Due to a fact that features such as threshold voltages and mobilities of thin film transistors (TFTs) in respective pixel circuits are different, the driving transistors in respective OLED pixel circuits may have different performance parameters accordingly. As a result, the currents flowing through respective OLEDs may be affected by different shifts of the threshold voltages Vth of the driving transistors, and thus be different, so that brightness uniformity and brightness consistence of the OLED display device are adversely affected, thereby display quality of the OLED display device is degraded.

Therefore, a compensation circuit is provided for each pixel circuit. The compensation circuit is connected to a gate electrode of the driving transistor, and is configured to maintain a voltage of the gate electrode of the driving transistor during a light-emitting period. Therefore, it is able for a current flowing through the OLED to be irrelevant to a threshold voltage Vth of the driving transistor, and eliminate the effect on the brightness uniformity and the brightness consistence of the OLED display device by the shifts of the threshold voltages.

However, in the related art, all of the compensation circuits have limited compensation ranges. When the threshold voltage shifts beyond the compensation range, the compensation circuit is invalidated. In a product including a plurality of OLED pixels, the voltage of the driving transistor in each of the OLED pixels has a unique initial value and a unique variation. Thus, when identical compensation circuits are provided for the plurality of OLED pixels respectively, it is possible that some of the compensation circuits are validated for their corresponding OLED pixels, while the other compensation circuits are invalidated for their corresponding OLED pixels. Consequently, the brightness uniformity and the brightness consistence of the OLED display device may be significantly affected.

SUMMARY

An object of the present disclosure is to provide an OLED pixel circuit, a display device and a method for controlling the OLED pixel unit, so as to enlarge the compensation range of the compensation circuit.

In one aspect, the present disclosure provides in some embodiments an OLED pixel circuit including:

an OLED;

a driving transistor, wherein a drain electrode of the driving transistor is connected to the OLED;

a first switching unit configured to connect a data signal output end and a gate electrode of the driving transistor;

a second switching unit configured to connect a power signal output end and a source electrode of the driving transistor; and a compensation circuit connected to the gate electrode of the driving transistor and configured to maintain a voltage of the gate electrode of the driving transistor during a light-emitting period, so as to enable a current flowing through the OLED to be irrelevant to a threshold voltage Vth of the driving transistor, the pixel circuit further includes:

a reference signal generation module configured to generate, based on a current threshold voltage of the driving transistor, a reference signal to be used by the compensation circuit, wherein a voltage of the reference signal and the threshold voltage meet at least one of validation conditions capable of validating the compensation circuit.

Alternatively, one column of OLED pixels share one reference signal generation module which includes:

a determination unit, configured to select a target driving circuit from driving circuits corresponding to the column of OLED pixels, wherein the reference signal is to be used by the target driving circuit; and a signal generation unit, configured to generate, based on a current threshold voltage of the driving transistor of the target driving circuit, a reference signal to be used by the compensation circuit of the target driving circuit, wherein a voltage of the reference signal generated by the signal generation unit and the current threshold voltage of the driving transistor of the target driving circuit meet at least one of validation conditions capable of validating the compensation circuit of the target driving circuit.

Alternatively, a first electrode of the OLED is connected to the driving transistor, a second electrode of the OLED is connected to the ground, and the compensation circuit includes:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED, during a reset period, the first switching unit is configured to be turned on and output the reference signal to the gate electrode of the driving transistor, and the second switching unit is configured to be turned on and output a first power signal to the source electrode of the driving transistor;

during a compensation period, the first switching unit is configured to be turned on and output the reference signal to the gate electrode of the driving transistor, and the second switching unit is configured to be turned on and output a second power signal to the source electrode of the driving transistor, wherein a voltage of the first power signal is lower than a voltage of the second power signal;

during a writing period, the first switching unit is configured to be turned on and output a data signal to the gate electrode of the driving transistor, and the second switching unit is configured to be turned off; and during the light-emitting period, the first switching unit is configured to be turned off, and the second switching unit is configured to be turned on and output the second power signal to the source electrode of the driving transistor.

Alternatively, the conditions includes:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor). In the above OLED pixel circuit, the first switching unit is a thin film transistor (TFT), a source electrode of which is connected to a data line, a drain electrode of which is connected to the gate electrode of the driving transistor, a gate electrode of which is connected to an output end of a first control signal, and which is configured to be turned on when the first control signal is effective, wherein the first control signal is effective during the reset period, the compensation period and the writing period; and the second switching unit is a TFT, a source electrode of which is connected to the power signal output end, a drain electrode of which is connected to the source electrode of the driving transistor, a gate electrode of which is connected to an output end of a second control signal, and which is configured to be turned on when the second control signal is effective, wherein the second control signal is effective during the reset period, the compensation period and the light-emitting period.

Alternatively, the signal generation unit is configured to:

during the reset period and the compensation period corresponding to the target driving circuit, generate, based on a current threshold voltage of the driving transistor of the target driving circuit, and output the reference signal to be used by the compensation circuit of the target driving circuit, wherein the voltage of the reference signal generated by the signal generation unit and the current threshold voltage of the driving transistor of the target driving circuit meet at least one of validation conditions capable of validating the compensation circuit of the target driving circuit.

Alternatively, the reference signal generation module further includes:

a third switching unit configured to connect the signal generation unit and the data line and output the reference signal generated by the signal generation unit to the data line during the reset period and the compensation period.

Alternatively, the third switching unit is a TFT, a source electrode of which is connected to the signal generation unit, a drain electrode of which is connected to the data line, a gate electrode of which is connected to the third control signal output end, and which is configured to be turned on when the third control signal is effective. The third control signal is effective during the reset period and the compensation period.

Alternatively, the reference signal generation module further includes a third switching unit configured to connect the signal generation unit and the data line and output the reference signal generated by the signal generation unit to the data line during the reset period and the compensation period. Moreover, the pixel circuit further includes a fourth switching unit configured to connect a data driving chip and the data line and output the data signal generated by the data driving chip to the data line during the writing period.

Alternatively, the third switching unit is a TFT, a source electrode of which is connected to the signal generation unit, a drain electrode of which is connected to the data line, a gate electrode of which is connected to an output end of a third control signal, and which is configured to be turned on when the third control signal is effective. The third control signal is effective during the reset period and the compensation period. The fourth switching unit is a TFT, a source electrode of which is connected to the data driving chip, a drain electrode of which is connected to the data line, a gate electrode of which is connected to an output end of a fourth control signal, and which is configured to be turned on when the fourth control signal is effective. The fourth control signal is effective during the writing period.

In another aspect, the present disclosure provides in some embodiments a display device including the above OLED pixel circuit.

In yet another aspect, the present disclosure provides in some embodiments a method for controlling the OLED pixel circuit, wherein the OLED pixel circuit includes:

an OLED;

a driving transistor; and a compensation circuit configured to maintain a voltage of a gate electrode of the driving transistor during a light-emitting period, so as to enable a current flowing through the OLED to be irrelevant to a threshold voltage Vth of the driving transistor, and the method includes a reference signal generation step of:

generating, based on a current threshold voltage of the driving transistor, a reference signal to be used by the compensation circuit, wherein a voltage of the reference signal and the threshold voltage meet at least one of validation conditions capable of validating the compensation circuit.

Alternatively, one column of OLED pixels share one reference signal generation module, and the reference signal generation step includes steps of:

selecting a target driving circuit from driving circuits corresponding to the column of OLED pixels, wherein the reference signal is to be used by the target driving circuit; and generating, based on a current threshold voltage of the driving transistor of the target driving circuit, a reference signal to be used by the compensation circuit of the target driving circuit, wherein a voltage of the generated reference signal and the current threshold voltage of the driving transistor of the target driving circuit meet at least one of validation conditions capable of validating the compensation circuit of the target driving circuit.

Alternatively, a first electrode of the OLED is connected to the driving transistor, a second electrode of the OLED is connected to the ground, and the compensation circuit includes:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED, the method further includes steps of:

during a reset period, turning on the first switching unit and outputting the reference signal to the gate electrode of the driving transistor, and turning on the second switching unit and outputting a first power signal to the source electrode of the driving transistor;

during a compensation period, turning on the first switching unit and outputting the reference signal to the gate electrode of the driving transistor, and turning on the second switching unit and outputting a second power signal to the source electrode of the driving transistor, wherein a voltage of the first power signal is lower than a voltage of the second power signal;

during a writing period, turning on the first switching unit and outputting a data signal to the gate electrode of the driving transistor, and turning off the second switching unit; and during the light-emitting period, turning off the first switching unit, and turning on the second switching unit and outputting the second power signal to the source electrode of the driving transistor.

Alternatively, the conditions includes:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor).

In the embodiments of the present disclosure, the reference signal is generated based on a current threshold voltage of the driving transistor, thereby when the threshold voltage changes, the reference voltage changes accordingly. In other words, the reference voltage may change according to the change of the threshold voltage, so as to enable the conditions of validating the compensation circuit to be met even when the threshold voltage changes, and enlarge the compensation range of the compensation circuit.

DETAILED DESCRIPTION

Figure 1:
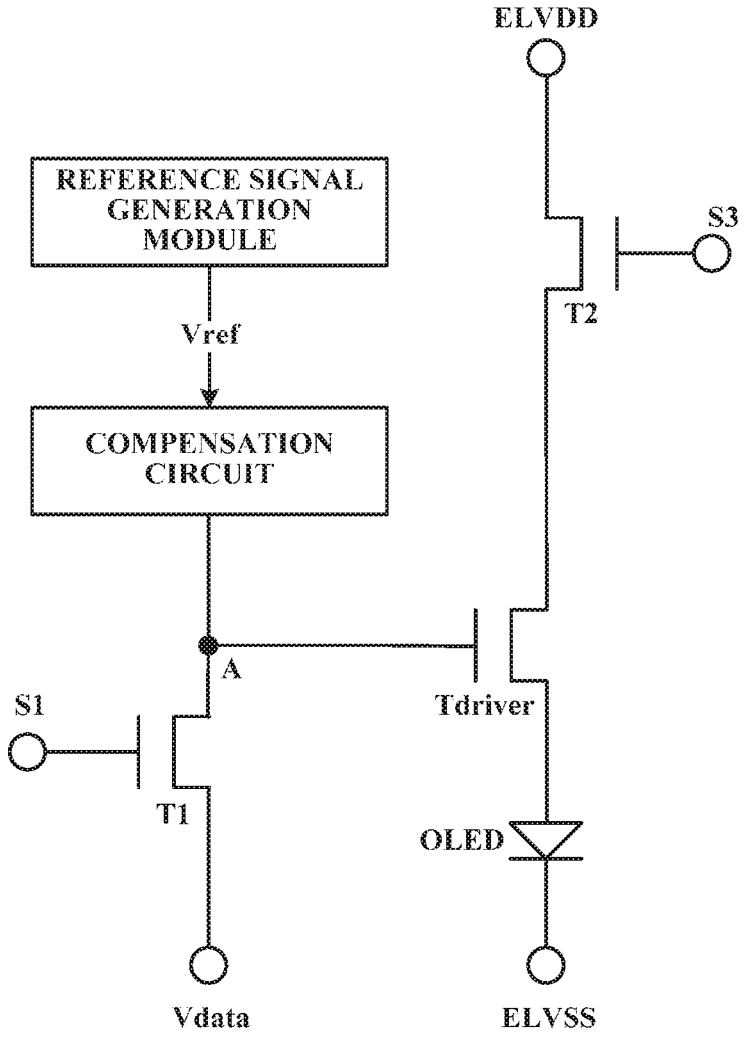
FIG. 1 illustrates an OLED pixel circuit according to an embodiment of the present disclosure.

In order to make the objects, the technical solutions and the advantages of the present disclosure more apparent, some technical solutions of the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

According to the OLED pixel circuit, the display device and the method for controlling the OLED pixel circuit in the embodiments of the present disclosure, a unique reference signal is generated based on each particular driving transistor, and the reference signal is used by the compensation circuit to enable the compensation circuit to be validated, so as to enlarge the compensation range of the compensation circuit.

As mentioned above, in the related art, all of the compensation circuits have limited compensation ranges. When the threshold voltage shifts beyond the compensation range, the compensation circuit is invalidated. In a product including a plurality of OLED pixels, the voltage of the driving transistor in each of the OLED pixels has a unique initial value and a unique variation. Thus, when identical compensation circuits are provided for the plurality of OLED pixels respectively, it is possible that some of the compensation circuits are validated for their corresponding OLED pixels, while the other compensation circuits are invalidated for their corresponding OLED pixels. As a consequence, the brightness uniformity and the brightness consistence of the OLED display device may be significantly affected.

There are two conventional solutions for the above problem:

1. providing a compensation circuit with a larger compensation range; and 2. providing a driving transistor with more stable performance.

It can be seen from above that the conventional solutions are focusing on improving the quality of hardware elements to validate the compensation circuit, which is common knowledge for designing the OLED driving circuit.

During the process of implementing the present disclosure with efforts and creative works, the inventor of the present disclosure finds out that, although various compensation circuits have been designed for the threshold voltage Vth of the driving transistor, none of such compensation circuits can operate properly unless one or more limiting conditions are met. Furthermore, at least some of the limiting conditions are relevant to both the threshold voltage Vth and the reference signal Vref, which limit the compensation range of the compensation circuit.

In other words, the conventional compensation circuit cannot operate properly unless the threshold voltage Vth and the reference voltage Vref meet a particular requirement. However, in the conventional driving circuit, the reference voltage Vref is constant, thereby the corresponding threshold voltage Vth is limited. Thus, it is possible that the above limiting conditions are no longer met when the threshold voltage Vth changes, so that the compensation circuit is invalidated.

In contrast, the present disclosure solves the problem of limited compensation range of the conventional compensation circuit from a viewpoint of signal design. As shown in FIG. 1, in the embodiment of the present disclosure, it is provided an OLED pixel circuit including:

an OLED;

a driving transistor Tdriver, wherein a drain electrode of the driving transistor is connected to the OLED;

a first switching unit T1 configured to connect a data signal output end and a gate electrode of the driving transistor Tdriver;

a second switching unit T2 configured to connect a power signal output end and a source electrode of the driving transistor Tdriver; and a compensation circuit connected to the gate electrode of the driving transistor and configured to maintain a voltage of the gate electrode of the driving transistor during a light-emitting period, so as to enable a current flowing through the OLED to be irrelevant to a threshold voltage Vth of the driving transistor, wherein the pixel circuit further includes:

a reference signal generation module configured to generate, based on a current threshold voltage of the driving transistor, a reference signal to be used by the compensation circuit, wherein a voltage of the reference signal and the threshold voltage meet at least one of validation conditions capable of validating the compensation circuit.

In this embodiment of the present disclosure, the reference signal is generated based on the current threshold voltage of the driving transistor. Thus, when the threshold voltage is changed, the reference voltage is changed accordingly. In other words, the reference voltage may change according to the change of the threshold voltage, so as to enable the conditions of validating the compensation circuit to be met even when the threshold voltage changes, and enlarge the compensation range of the compensation circuit.

In addition, the present disclosure solves the problem of limited compensation range of the conventional compensation circuit and obtains the solutions from a viewpoint of signal design instead of a viewpoint of just circuit design.

In the embodiments of the present disclosure, the reference signal generation module generates the reference signal based on factors such as the threshold voltage, and the threshold voltage may be obtained in one of many modes. In the following, two of the modes are briefly explained.

Mode 1

A detecting circuit is arranged in each driving circuit and configured to detect the current threshold voltage of the driving transistor.

Due to a fact that the threshold voltage of the driving transistor shifts insignificantly during a short period of time, the detecting frequency of the detecting circuit may be determined based on the requirement. For example, the threshold voltage is detected every time the driving circuit is turned on. In this case, the driving circuit operates based on this threshold voltage until it is turned off. Alternatively, the threshold voltage of the driving transistor may be detected and updated by the detecting circuit at regular interval of time, e.g. 1 hour or 2 hours, which is not particularly defined herein.

Mode 2

A diagram or a table representing a relation between the threshold voltage and a length of operation time of the driving transistor may be obtained in advance, and then the length of the operation time of the driving transistor is recorded in real time.

When the reference signal generation module needs to generate the reference signal, it determines the current threshold voltage of the driving transistor based on the length of the operation time, and generates the reference signal based on the current threshold voltage of the driving transistor.

The above are merely two examples of the modes for obtaining the current threshold voltage of the driving transistor, which are not particularly defined herein.

Since the conventional OLED display panel includes a plurality of unique OLED pixels, one reference signal generation module may be arranged for each of the OLED pixels.

However, a circuit with such arrangement is complicated. In addition, a whole display panel may be adversely affected no matter whether the reference signal generation modules are arranged at a display region or a non-display region of the display panel. In particular, when the reference signal generation modules are arranged at the display region, the aperture ratio of the display panel has to be reduced; in contrast, when the reference signal generation modules are arranged at the non-display region, a bezel of the display panel has to be widen, which is against a trend of slim product.

An existing display panel is scanned line by line, and thus the reference voltage is used by each of the pixels in an identical column during different period of time.

As a result, in contrast to a solution of arranging one reference signal generation module for each of the OLED pixels which has disadvantages such as high cost, the present disclosure provides in some embodiment an alternative solution. In this solution, a reference signal generation module is arranged for each column of OLED pixels, i.e. one column of OLED pixels share one reference signal generation module. Thus, the reference signal generation module may generate and output voltages of reference signals for corresponding OLED pixels during different periods.

In the above mode, one column of OLED pixels share one reference signal generation module, and the reference signal generation module includes:

a determination unit, configured to select a target driving circuit from driving circuits corresponding to the column of OLED pixels, wherein the reference signal is to be used by the target driving circuit; and a signal generation unit, configured to generate, based on a current threshold voltage of the driving transistor of the target driving circuit, a reference signal to be used by the compensation circuit of the target driving circuit. A voltage of the reference signal generated by the signal generation unit and the current threshold voltage of the driving transistor of the target driving circuit meet at least one of validation conditions capable of validating the compensation circuit of the target driving circuit In the embodiments of the present disclosure, the determination unit determines the driving circuit currently requiring the reference signal in real time, determines the particular threshold voltage Vth of the driving transistor in the driving circuit, and then generates the corresponding reference signal based on the particular threshold voltage Vth. Here, the corresponding reference signal meets the validation conditions capable of validating the compensation circuit of the target driving circuit. In this embodiment, the reference signal generation unit is reused by the pixels in one column based on the fact that the pixels in one column uses the reference signals during different periods of time, so that the pixels in one column merely require one reference signal generation module. As a result, the number of the hardware elements in the circuit is significantly reduced, thereby the cost for manufacturing the OLED pixel circuit is reduced.

Furthermore, when the reference signal generation modules are arranged at the display region, compared with the solution that a reference signal generation module is arranged for each OLED pixels, the aperture ratio of the display panel may be increased in the present solution in which one column of OLED pixels share one reference signal generation module. On the other hand, when the reference signal generation modules are arranged at the non-display region, compared with the solution that a reference signal generation module is arranged for each OLED pixels, an area occupied by the reference signal generation modules on the non-display region may be reduced in the present solution in which one column of OLED pixels share one reference signal generation module, so as to facilitate to narrow the bezel of the display panel.

In the related art, the reference signal s output to the corresponding compensation circuit via an independent signal transmission line under the control of an independent transistor. As a result, both the number of the transistors and the number of the data lines are large.

The present disclosure provides in some embodiments an OLED pixel circuit for reducing the number of the transistors and the number of the data lines. In the OLED pixel circuit, the reference signals and the data signals are transmitted by the data lines in a time-sharing manner under the control of one transistor, so that both the number of the TFTs and the number of the data transmission lines are reduced.

Figure 2:
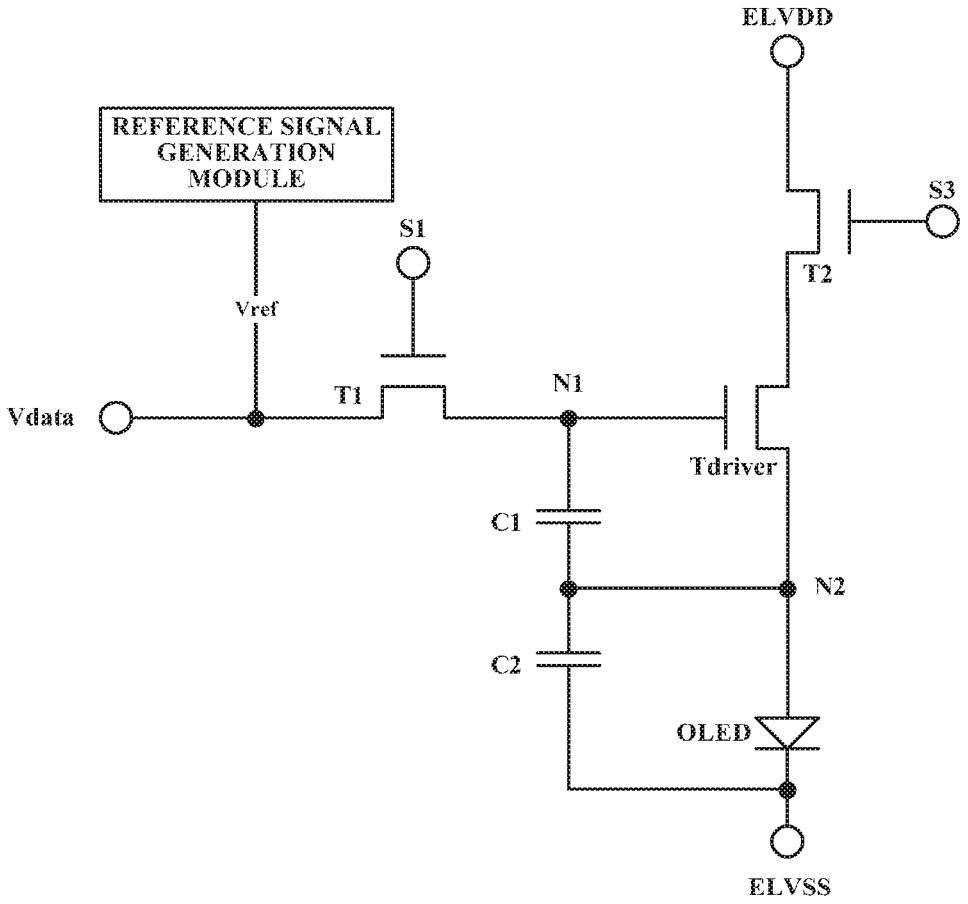
FIG. 2 illustrates another OLED pixel circuit according to an embodiment of the present disclosure.

As shown in FIG. 2, a first electrode of the OLED is connected to the driving transistor Tdriver, a second electrode of the OLED is connected to the ground ELVSS, and the compensation circuit includes:

a first capacitor C1, wherein one end N1 of the first capacitor C1 is connected to the gate electrode of the driving transistor, and the other end N2 of the first capacitor C1 is connected to the drain electrode of the driving transistor; and a second capacitor C2, wherein one end of the second capacitor C2 is connected to the drain electrode of the driving transistor, and the other end of the second capacitor C2 is connected to the second electrode of the OLED.

The ground ELVSS is another voltage source being different from an output end of a power source, and configured to cooperate with an output end of the power source to drive the OLED to emit light.

In the above embodiment, during a reset period, the first switching unit T1 is configured to be turned on and output the reference signal to the gate electrode of the driving transistor, and the second switching unit T2 is configured to be turned on and output a first power signal to the source electrode of the driving transistor;

during a compensation period, the first switching unit T1 is configured to be turned on and output the reference signal to the gate electrode of the driving transistor, and the second switching unit T2 is configured to be turned on and output a second power signal to the source electrode of the driving transistor, wherein a voltage of the first power signal is lower than a voltage of the second power signal;

during a writing period, the first switching unit T1 is configured to be turned on and output a data signal to the gate electrode of the driving transistor, and the second switching unit T2 is configured to be turned off; and during the light-emitting period, the first switching unit T1 is configured to be turned off, and the second switching unit T2 is configured to be turned on and output the second power signal to the source electrode of the driving transistor.

Figure 3:
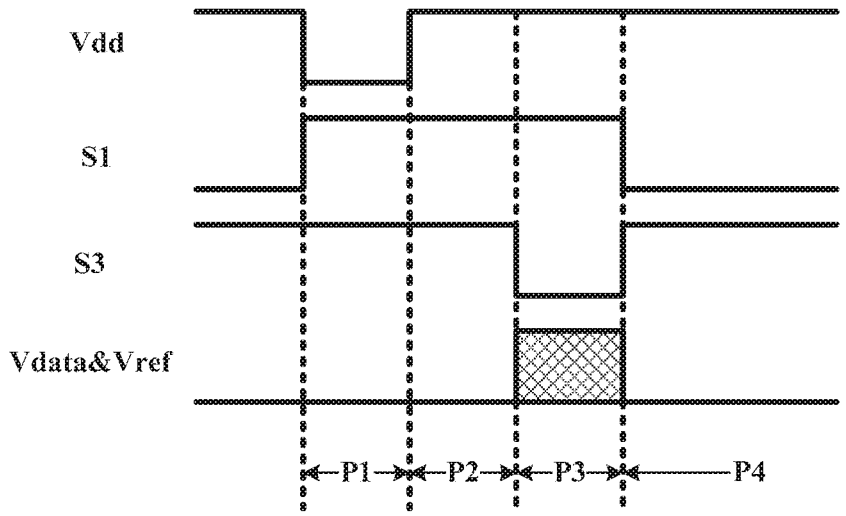
FIG. 3 illustrates a signal timing sequence of the pixel circuit as shown in FIG. 2.

FIG. 3 illustrates the timing sequence of the above driving circuit.

As shown in FIGS. 2 and 3, the above circuit operates as follows.

The above 3T2C circuit generally operates in four periods, i.e. the reset period, the compensation period, the writing period and the light-emitting period.

During the reset period, all TFTs are turned on, the reference signal is written to the node N1, the signal of a previous time frame is cleared, and the first power signal is written to the node N2 by the transistor T2.

During the compensation period, all TFTs are turned on, the power signal changes from being of a low level to being of a high level, and the power signal is progressively written to the node node N2 by the transistor T2 and the transistor Tdriver. During this period, a voltage at the node N2 is progressively recharged to be equal to a difference between the reference voltage and the threshold voltage Vth (T1), and the transistor Tdriver is turned off, so that the compensation process ends.

In other words, during the above compensation period, it is necessary to eliminate the effect on the capacitor C1 by the data signal of the previous time frame. Thus, a reference signal is inputted to the node N1, and the node N2 is cleared by the first voltage signal being of a low level. During the compensation period, the second source signal is progressively written to the node N2 by the transistor T2 and the transistor Tdriver, and the voltage at the node N2 is increased to be equal to a difference between the reference voltage and the threshold voltage Vth (T1) by the second power signal.

Thus, the voltage of the first power signal written to the node N2 by the transistor T2 during the reset period is less than the voltage of the second power signal written to the node N2 by the transistor T2 during the compensation period. In the related art, the signal inputted by ELVDD generally has a constant value. In the present disclosure, the voltage of the signal inputted to the node N2 changes during different periods according to a change of an amplitude of the signal inputted by ELVDD, so as to reduce the number of the signal transmission lines.

During the writing period, the transistor T2 is turned off, both the transistor T1 and the transistor Tdriver are turned on, and the data signal Vdata is written to the node N1 by the transistor T1. At this point, the node N2 is in a floating state, and the voltage at the node N2 changes according to the change of the voltage at the node N1. As a result, the voltage at the node N2 is increased according to an increase of the voltage at the node N1 during this period.

During the light-emitting period, the transistor T1 is turned off, both the transistor T2 and the transistor Tdriver are turned on, and then a circuit is formed by the second power source, the transistor T2, the transistor Tdriver, the OLED and the ground ELVSS so as to drive the OLED to emit light.

During the light-emitting period, the node N2 is reconnected to the ELVDD by the transistor T2, and the voltage may change. At this point, the node N1 is in a floating state, and the voltage at the node N1 is increased in proportion to an increase of the voltage at the node N2. Thus, the increased voltage at the node N1 includes the threshold voltage of the driving transistor, so as to enable the current flowing through the OLED to be irrelevant to a threshold voltage Vth of the driving transistor.

In the above arrangement, the reference signal generation module generates the reference signal based on the validation conditions and the current threshold voltage of the transistor Tdriver, so that the voltage of the reference signal and the threshold voltage always meet validation conditions capable of validating the compensation circuit.

Furthermore, in the above arrangement, both the reference signal and the data signal are controlled by one transistor T1, and transmitted by one signal transmission line (i.e. the data line). As a result, both the number of the data transmission lines and the number of the transistors are reduced, the circuit is simplified, and the product cost is reduced.

The validation conditions capable of validating the compensation circuit in the arrangement as shown in FIG. 2 are explained as follows.

In the 3T2C pixel circuit as shown in FIG. 2, the validation conditions capable of validating the compensation circuit may include:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$ is a proportional coefficient and equals to C1/(C1+C2).

It should be appreciated that, when the compensation circuit is required to implement compensation in any given situation, the compensation circuit has to meet many conditions, and a failure of meeting any of these conditions may lead to the validation range to be narrowed. Thus, the compensation range of the compensation circuit may be enlarged when each validation condition is satisfied.

As a result, in the embodiments of the present disclosure, the compensation range may be enlarged when the voltage of the reference signal and the threshold voltage meet at least one of validation conditions capable of validating the compensation circuit. In an embodiment, all of the validation conditions relevant to the threshold voltage may be met, so as to enable the validation of the compensation circuit to be met irrespective of any shift of the threshold voltage.

As shown in FIGS. 2 and 3, the first switching unit is a thin film transistor (TFT), a source electrode of which is connected to a data line, a drain electrode of which is connected to the gate electrode of the driving transistor, a gate electrode of which is connected to an output end of a first control signal S1, and which is configured to be turned on when the first control signal is effective, wherein the first control signal is effective during the reset period, the compensation period and the writing period; and the second switching unit is a TFT, a source electrode of which is connected to the power signal output end, a drain electrode of which is connected to the source electrode of the driving transistor, a gate electrode of which is connected to an output end of a second control signal S3, and which is configured to be turned on when the second control signal is effective, wherein the second control signal is effective during the reset period, the compensation period and the light-emitting period.

In an embodiment, as shown in FIG. 2, the reference signal generation module may output the reference signal to the data line in many modes, which are illustrated as follows.

In Mode 1, the output end is directly connected to the data line, and the reference signal generation module merely generates the reference signal during the reset period and the compensation period.

As shown in FIG. 3, during the reset period and the compensation period, a combination of the reference signal and the data signal is transmitted via the data line. A null signal is outputted by the data driving chip. Then a combination of the reference signal and the null signal is the reference signal. During the writing period, the reference signal generation module outputs the null signal to the data line, thereby a combination of the null signal and the data signal is the data signal. During the light-emitting period, S1 is turned off, and none of the signals transmitted on the data line may affect the pixel circuit.

Thus, the reference signals of the data signals may be transmitted in the time-sharing manner in the Mode 1.

In other words, in the Mode 1, during the reset period and the compensation period corresponding to the target driving circuit, the signal generate unit generate, based on a current threshold voltage of the driving transistor of the target driving circuit, and output the reference signal to be used by the compensation circuit of the target driving circuit. Here, a voltage of the reference signal generated by the signal generation unit and the current threshold voltage of the driving transistor of the target driving circuit meet at least one of validation conditions capable of validating the compensation circuit of the target driving circuit.

The above Mode 1 has a simple structure, but requires the reference signal generation module to generate and output the reference signal in a precise time.

Alternatively, a Mode 2 may be adopted to reduce the cost. In Mode 2, one or more TFTs are added, so that the timing for outputting the signal generated by the reference signal generation module to the data line is controlled by the TFT. At this point, in the pixel, the added TFT are turned on during the reset period and the compensation period, and are turned off during other time periods.

Figure 4:
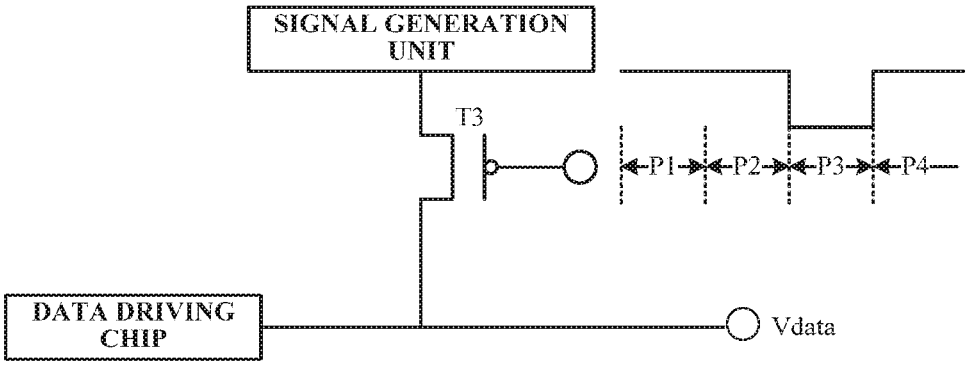
FIG. 4 illustrates a connection between a signal generation unit and a data line in the OLED pixel circuit as shown in FIG. 2.

In the above embodiment, as shown in FIG. 4, the reference signal generation module further includes:

a third switching unit T3 configured to connect signal generation unit and the data line and output the reference signal generated by the signal generation unit to the data line during the reset period and the compensation period.

As shown in FIG. 4, the third switching unit T3 is a TFT, a source electrode of which is connected to the signal generation unit, a drain electrode of which is connected to the data line, a gate electrode of which is connected to an output end of a third control signal, and which is configured to be turned on when the third control signal is effective. The third control signal is effective during the reset period and the compensation period.

Figure 5:
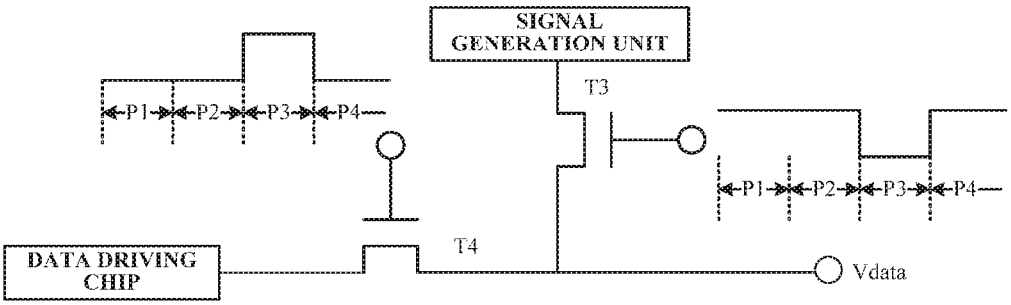
FIG. 5 illustrates a connection between the signal generation unit as well as a data driving chip and the data line in the OLED pixel circuit as shown in FIG. 2.

In the above embodiment, during the reset period and the compensation period, the null signal may be outputted by the data driving chip with some noises, which may interfere the reference signal. In a further embodiment, a TFT is added to reduce such noises. As shown in FIG. 5, the reference signal generation module further includes a third switching unit T3 configured to connect the signal generation unit and the data line and output the reference signal generated by the signal generation unit to the data line during the reset period and the compensation period. The pixel circuit further includes a fourth switching unit T4 configured to connect a data driving chip and the data line and output the data signal generated by the data driving chip to the data line during the writing period.

As shown in FIG. 5, the third switching unit is a TFT, a source electrode of which is connected to the signal generation unit, a drain electrode of which is connected to the data line, a gate electrode of which is connected to an output end of the third control signal, and which is configured to be turned on when the third control signal is effective. The third control signal is effective during the reset period and the compensation period. The fourth switching unit is a TFT, a source electrode of which is connected to the data driving chip, a drain electrode of which is connected to the data line, a gate electrode of which is connected to an output end of a fourth control signal, and which is configured to be turned on when the fourth control signal is effective. The fourth control signal is effective during the writing period.

The OLED pixel circuit has been described by taking the specific 3T2C pixel circuit as an example. However, the present disclosure is not limited to such embodiments, and the OLED pixel circuit may be implemented by another pixel circuit, such as the 4T2C pixel circuit which is shown in FIG. 6 and corresponds to the timing sequence of FIG. 7.

Figure 6:
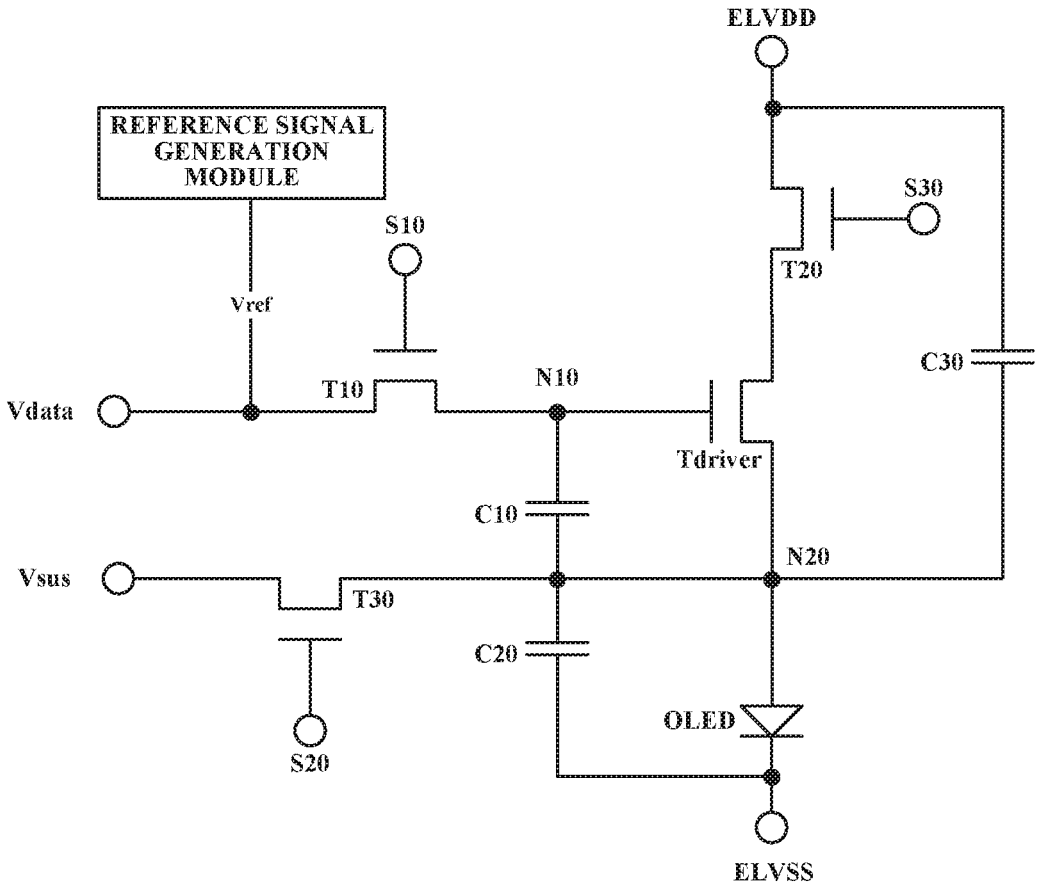
FIG. 6 illustrates yet another OLED pixel circuit according to an embodiment of the present disclosure.
Figure 7:
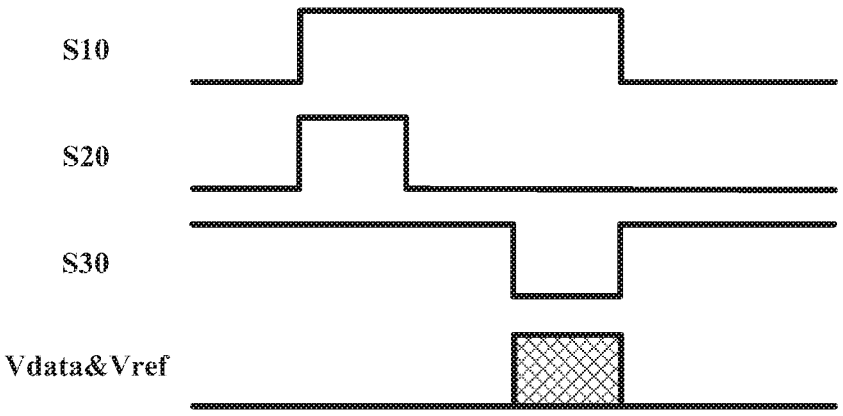
FIG. 7 illustrates a signal timing sequence of the pixel circuit as shown in FIG. 6.

As shown in FIGS. 6 and 7, the 4T2C circuit operates as follows.

The above 4T2C circuit generally operates in four periods, i.e. the reset period, the compensation period, the writing period and the light-emitting period.

During the reset period, all TFTs are turned on, the reference signal is written to the node N10, the signal of a previous time frame is cleared, and the signal Vsus is written to the node N20 by the transistor T30. The signal Vsus represents a low voltage which is less than the voltage of the reference signal written to the node N10.

During the compensation period, both the transistor T10 and the transistor T20 are turned on, and the transistor T30 are turned off. The power signal is progressively written to the node N20 by the transistor T20 and the transistor Tdriver, the voltage at the node N20 is recharged to be equal to a difference between the reference voltage and the threshold voltage Vth (T10), and the transistor Tdriver is turned off, so that the compensation process ends.

During the writing period, both the transistor T20 and the transistor T30 are turned off, both the transistor T10 and the transistor Tdriver are turned on, and the data signal Vdata is written to the node N10 by the transistor T10.

During the light-emitting period, both the transistor T10 and the transistor T30 are turned off, both the transistor T20 and the transistor Tdriver are turned on, and then a circuit is formed by the power source, the transistor T20, the transistor Tdriver, the OLED and the ground ELVSS so as to drive the OLED to emit light.

During the light-emitting period, the node N20 is reconnected to ELVDD by the transistor T20, and the voltage thereof may be changed. At this time, the node N10 is in a floating state, and the voltage at the node N10 is increased in proportion to an increase of the voltage at the node N20. Thus, the increased voltage at the node N10 includes the threshold voltage of the driving transistor, so as to enable the current flowing through the OLED to be irrelevant to a threshold voltage Vth of the driving transistor.

As can been seen from above, the validation conditions relevant to the reference voltage may include:

$$A>F; \text{ and}$$

$$A-B+\alpha(C-A)<D;$$

where

A indicates a voltage value of the reference signal;

B indicates the threshold voltage of the driving transistor;

C indicates a voltage value of the data signal;

D indicates a threshold voltage of the OLED;

F indicates the voltage Vsus.

$\alpha$ is a proportional coefficient and equals to C10/(C10+C20).

The embodiments of the present disclosure are described by taking N-type transistors as an example. However, it should be appreciated that the present disclosure is not limited to the above embodiments, and each of the N-type transistors may be replaced by a N-type TFT or a complementary metal oxide semiconductor (CMOS) transistor based on a corresponding timing sequence. When a P-type transistor functioning as a switch is used to replace the N-type transistor, the timing sequence is merely required to be amended by changing the original high levels to the low levels and changing the original low levels to the high levels. When the driving transistor is replaced, the location of the OLED and the design of the power signal should be changed accordingly, which is known for a person skilled in the art and thus is omitted herein.

In another aspect, the present disclosure provides in some embodiments a display device including the above OLED pixel circuit.

The display device may be an electronic paper, an OLED panel, a mobile phone, a tablet computer, a television, a monitor, a notebook computer, a digital picture frame, a navigator or any other product or member having a display function.

In yet another aspect, the present disclosure provides in some embodiments a method for controlling the OLED pixel circuit, wherein the OLED pixel circuit includes:

an OLED;

a driving transistor; and a compensation circuit configured to maintain a voltage of a gate electrode of the driving transistor during a light-emitting period, so as to enable a current flowing through the OLED to be irrelevant to a threshold voltage Vth of the driving transistor, the method includes a reference signal generation step of generating, based on a current threshold voltage of the driving transistor, a reference signal to be used by the compensation circuit, wherein a voltage of the reference signal and the threshold voltage meet at least one of validation conditions capable of validating the compensation circuit.

When one column of OLED pixels share one reference signal generation module, the reference signal generation module includes:

selecting a target driving circuit from driving circuits corresponding to the column of OLED pixels, wherein the reference signal is to be used by the target driving circuit; and generating, based on a current threshold voltage of the driving transistor of the target driving circuit, a reference signal to be used by the compensation circuit of the target driving circuit, wherein a voltage of the generated reference signal and the current threshold voltage of the driving transistor of the target driving circuit meet at least one of validation conditions capable of validating the compensation circuit of the target driving circuit.

In an embodiment, a first electrode of the OLED is connected to the driving transistor, a second electrode of the OLED is connected to the ground, and the compensation circuit includes: a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED, and the method further includes steps of:

during a reset period, turning on the first switching unit and outputting the reference signal to the gate electrode of the driving transistor, and turning on the second switching unit and outputting a first power signal to the source electrode of the driving transistor;

during a compensation period, turning on the first switching unit and outputting the reference signal to the gate electrode of the driving transistor, and turning on the second switching unit and outputting a second power signal to the source electrode of the driving transistor, wherein a voltage of the first power signal is lower than a voltage of the second power signal;

during a writing period, turning on the first switching unit and outputting a data signal to the gate electrode of the driving transistor, and turning off the second switching unit; and during the light-emitting period, turning off first switching unit, and turning on the second switching unit and outputting the second power signal to the source electrode of the driving transistor.

The above are merely the preferred embodiments of the present disclosure. It should be noted that, a person skilled in the art may make improvements and modifications without departing from the principle of the present disclosure, and these improvements and modifications shall also fall within the scope of the present disclosure.

What is claimed is:

1. An organic light-emitting diode (OLED) pixel circuit, comprising:

an OLED;

a driving transistor, wherein a drain electrode of the driving transistor is connected to the OLED;

a first switching unit configured to connect a data signal output end and a gate electrode of the driving transistor;

a second switching unit configured to connect a power signal output end and a source electrode of the driving transistor; and a compensation circuit connected to the gate electrode of the driving transistor and configured to maintain a voltage of the gate electrode of the driving transistor during a light-emitting period, so as to enable a current flowing through the OLED to be irrelevant to a threshold voltage Vth of the driving transistor, wherein the pixel circuit further comprises:

a reference signal generation module configured to generate, based on a current threshold voltage of the driving transistor, a reference signal to be used by the compensation circuit, wherein a voltage of the reference signal and the threshold voltage meet at least one of validation conditions capable of validating the compensation circuit;

wherein one column of OLED pixels share one reference signal generation module which comprises:

a determination unit, configured to select a target driving circuit from driving circuits corresponding to the column of OLED pixels, wherein the reference signal is to be used by the target driving circuit; and a signal generation unit, configured to generate, based on a current threshold voltage of the driving transistor of the target driving circuit, a reference signal to be used by the compensation circuit of the target driving circuit, wherein a voltage of the reference signal generated by the signal generation unit and the current threshold voltage of the driving transistor of the target driving circuit meet at least one of validation conditions capable of validating the compensation circuit of the target driving circuit.

2. The OLED pixel circuit according to claim 1, wherein a first electrode of the OLED is connected to the driving transistor, a second electrode of the OLED is connected to the ground, and the compensation circuit comprises:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED.

3. The OLED pixel circuit according to claim 2, wherein during a reset period, the first switching unit is configured to be turned on and output the reference signal to the gate electrode of the driving transistor, and the second switching unit is configured to be turned on and output a first power signal to the source electrode of the driving transistor;

during a compensation period, the first switching unit is configured to be turned on and output the reference signal to the gate electrode of the driving transistor, and the second switching unit is configured to be turned on and output a second power signal to the source electrode of the driving transistor, wherein a voltage of the first power signal is lower than a voltage of the second power signal;

during a writing period, the first switching unit is configured to be turned on and output a data signal to the gate electrode of the driving transistor, and the second switching unit is configured to be turned off; and during the light-emitting period, the first switching unit is configured to be turned off, and the second switching unit is configured to be turned on and output the second power signal to the source electrode of the driving transistor.

4. The OLED pixel circuit according to claim 3, wherein the conditions comprise:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor).

5. The OLED pixel circuit according to claim 3, wherein the first switching unit is a thin film transistor (TFT), a source electrode of which is connected to a data line, a drain electrode of which is connected to the gate electrode of the driving transistor, a gate electrode of which is connected to an output end of a first control signal, and which is configured to be turned on when the first control signal is effective, wherein the first control signal is effective during the reset period, the compensation period and the writing period; and the second switching unit is a TFT, a source electrode of which is connected to the power signal output end, a drain electrode of which is connected to the source electrode of the driving transistor, a gate electrode of which is connected to an output end of a second control signal, and which is configured to be turned on when the second control signal is effective, wherein the second control signal is effective during the reset period, the compensation period and the light-emitting period.

6. The OLED pixel circuit according to claim 5, wherein the signal generation unit is configured to:

during the reset period and the compensation period corresponding to the target driving circuit, generate, based on a current threshold voltage of the driving transistor of the target driving circuit, and output the reference signal to be used by the compensation circuit of the target driving circuit, wherein the voltage of the reference signal generated by the signal generation unit and the current threshold voltage of the driving transistor of the target driving circuit meet at least one of validation conditions capable of validating the compensation circuit of the target driving circuit.

7. The OLED pixel circuit according to claim 5, wherein the reference signal generation module further comprises:

a third switching unit configured to connect the signal generation unit and the data line and output the reference signal generated by the signal generation unit to the data line during the reset period and the compensation period.

8. The OLED pixel circuit according to claim 7, wherein the third switching unit is a TFT, a source electrode of which is connected to the signal generation unit, a drain electrode of which is connected to the data line, a gate electrode of which is connected to an output end of a third control signal, and which is configured to be turned on when the third control signal is effective, wherein the third control signal is effective during the reset period and the compensation period.

9. The OLED pixel circuit according to claim 5, wherein the reference signal generation module further comprises:

a third switching unit configured to connect the signal generation unit and the data line and output the reference signal generated by the signal generation unit to the data line during the reset period and the compensation period; and the pixel circuit further comprises: a fourth switching unit configured to connect a data driving chip and the data line and output the data signal generated by the data driving chip to the data line during the writing period.

10. The OLED pixel circuit according to claim 9, wherein the third switching unit is a TFT, a source electrode of which is connected to the signal generation unit, a drain electrode of which is connected to the data line, a gate electrode of which is connected to an output end of a third control signal, and which is configured to be turned on when the third control signal is effective, wherein the third control signal is effective during the reset period and the compensation period; and the fourth switching unit is a TFT, a source electrode of which is connected to the data driving chip, a drain electrode of which is connected to the data line, a gate electrode of which is connected to an output end of a fourth control signal, and which is configured to be turned on when the fourth control signal is effective, wherein the fourth control signal is effective during the writing period.

11. A display device comprising the OLED pixel circuit according to claim 1.

12. The display device according to claim 11, wherein a first electrode of the OLED is connected to the driving transistor, a second electrode of the OLED is connected to the ground, and the compensation circuit comprises:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED.

13. The display device according to claim 12, wherein during a reset period, the first switching unit is configured to be turned on and output the reference signal to the gate electrode of the driving transistor, and the second switching unit is configured to be turned on and output a first power signal to the source electrode of the driving transistor;

during a compensation period, the first switching unit is configured to be turned on and output the reference signal to the gate electrode of the driving transistor, and the second switching unit is configured to be turned on and output a second power signal to the source electrode of the driving transistor, wherein a voltage of the first power signal is lower than a voltage of the second power signal;

during a writing period, the first switching unit is configured to be turned on and output a data signal to the gate electrode of the driving transistor, and the second switching unit is configured to be turned off; and during the light-emitting period, the first switching unit is configured to be turned off, and the second switching unit is configured to be turned on and output the second power signal to the source electrode of the driving transistor.

14. The display device according to claim 13, wherein the conditions comprise:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor).

15. A method for controlling an organic light-emitting diode (OLED) pixel circuit, wherein the OLED pixel circuit comprises:

an OLED;

a driving transistor; and a compensation circuit configured to maintain a voltage of a gate electrode of the driving transistor during a light-emitting period, so as to enable a current flowing through the OLED to be irrelevant to a threshold voltage Vth of the driving transistor, wherein the method comprises a reference signal generation step of:

generating, based on a current threshold voltage of the driving transistor, a reference signal to be used by the compensation circuit, wherein a voltage of the reference signal and the threshold voltage meet at least one of validation conditions capable of validating the compensation circuit;

wherein one column of OLED pixels share one reference signal generation module, and the reference signal generation step comprises:

selecting a target driving circuit from driving circuits corresponding to the column of OLED pixels, wherein the reference signal is to be used by the target driving circuit; and generating, based on a current threshold voltage of the driving transistor of the target driving circuit, a reference signal to be used by the compensation circuit of the target driving circuit, wherein a voltage of the generated reference signal and the current threshold voltage of the driving transistor of the target driving circuit meet at least one of validation conditions capable of validating the compensation circuit of the target driving circuit.

16. The method according to 15, wherein a first electrode of the OLED is connected to the driving transistor, a second electrode of the OLED is connected to the ground, and the compensation circuit comprises:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED, the method further comprises steps of:

during a reset period, turning on the first switching unit and outputting the reference signal to the gate electrode of the driving transistor, and turning on the second switching unit and outputting a first power signal to the source electrode of the driving transistor;

during a compensation period, turning on the first switching unit and outputting the reference signal to the gate electrode of the driving transistor, and turning on the second switching unit and outputting a second power signal to the source electrode of the driving transistor, wherein a voltage of the first power signal is lower than a voltage of the second power signal;

during a writing period, turning on the first switching unit and outputting a data signal to the gate electrode of the driving transistor, and turning off the second switching unit; and during the light-emitting period, turning off the first switching unit, and turning on the second switching unit and outputting the second power signal to the source electrode of the driving transistor.

17. The method according to 15, wherein the conditions comprise:

$A-B+\alpha(C-A)<D$; and/or $E<A-B$, where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor).

18. A method for controlling an organic light-emitting diode (OLED) pixel circuit, wherein the OLED pixel circuit comprises:

an OLED;

a driving transistor; and a compensation circuit configured to maintain a voltage of a gate electrode of the driving transistor during a light-emitting period, so as to enable a current flowing through the OLED to be irrelevant to a threshold voltage Vth of the driving transistor, wherein the method comprises a reference signal generation step of:

generating, based on a current threshold voltage of the driving transistor, a reference signal to be used by the compensation circuit, wherein a voltage of the reference signal and the threshold voltage meet at least one of validation conditions capable of validating the compensation circuit;

wherein a first electrode of the OLED is connected to the driving transistor, a second electrode of the OLED is connected to the ground, and the compensation circuit comprises:

a first capacitor, wherein an end of the first capacitor is connected to the gate electrode of the driving transistor, and the other end of the first capacitor is connected to the drain electrode of the driving transistor; and a second capacitor, wherein an end of the second capacitor is connected to the drain electrode of the driving transistor, and the other end of the second capacitor is connected to the second electrode of the OLED, the method further comprises:

during a reset period, turning on the first switching unit and outputting the reference signal to the gate electrode of the driving transistor, and turning on the second switching unit and outputting a first power signal to the source electrode of the driving transistor;

during a compensation period, turning on the first switching unit and outputting the reference signal to the gate electrode of the driving transistor, and turning on the second switching unit and outputting a second power signal to the source electrode of the driving transistor, wherein a voltage of the first power signal is lower than a voltage of the second power signal;

during a writing period, turning on the first switching unit and outputting a data signal to the gate electrode of the driving transistor, and turning off the second switching unit; and during the light-emitting period, turning off the first switching unit, and turning on the second switching unit and outputting the second power signal to the source electrode of the driving transistor.

19. The method according to 18, wherein the conditions comprise:

$$A-B+\alpha(C-A)<D; \text{ and/or}$$

$$E<A-B,$$

where

A indicates a voltage value of the reference signal;

B indicates the threshold voltage of the driving transistor;

C indicates a voltage value of the data signal;

D indicates a threshold voltage of the OLED;

E indicates a voltage value of the first power signal; and $\alpha$=a capacitance value of the first capacitor/(the capacitance value of the first capacitor+a capacitance value of the second capacitor).

* * * * *